United States Patent [19]

Brush et al.

[11] 4,257,663

[45] Mar. 24, 1981

[54] BALL LOADED ANTI-DECOUPLING DEVICE FOR ELECTRICAL CONNECTORS

[75] Inventors: Robert W. Brush, Unadilla; Dee A. Werth, Nineveh; Alan L. Schildkraut, Sidney, all of N.Y.

[73] Assignee: The Bendix Corporation, Southfield, Mich.

[21] Appl. No.: 101,372

[22] Filed: Dec. 7, 1979

[51] Int. Cl.[3] ..... H01R 13/62

[52] U.S. Cl. ..... 339/89 M; 411/298

[58] Field of Search ..... 339/89–91 B, 339/113; 285/81, 82, 87, 88; 151/25 B, 25 C

[56] References Cited

U.S. PATENT DOCUMENTS

| | | | |
|---|---|---|---|
| 1,093,666 | 4/1914 | Wegener | 151/25 B |
| 1,309,421 | 7/1919 | Shults | 151/25 C |
| 2,660,212 | 11/1953 | Allen | 151/25 B |
| 3,587,032 | 6/1971 | Normann | 339/89 M |
| 4,109,990 | 8/1978 | Waldron et al. | 339/89 M |

*Primary Examiner*—Eugene F. Desmond

*Attorney, Agent, or Firm*—John R. Benefiel; Raymond J. Eifler

[57] ABSTRACT

An anti-vibration arrangement for resisting unthreading rotation between a coupling nut and mated components is disclosed, consisting of a deflectable mandrel extending in a radial plane chordally across an interior bore formed in the coupling nut, which mandrel mounts a slidable ball. The mandrel passes adjacent an outer surface portion of one of the electrical connector components defining a clearance space of a smaller dimension than the ball, while the ball is axially positioned in frictional engagement with the surface portion on either side of the clearance space. Rotation of the nut is resisted only minimally in a direction tending to move the ball away from the clearance space while tending to be wedged by rotation in the opposite direction. On exertion of a turning force in the wedging direction sufficient to cause deflection of the mandrel, the ball passes through the clearance space which results in greatly reduced resistance to continued rotation in that direction enabling ready uncoupling of the connector elements.

10 Claims, 3 Drawing Figures

370-79-0500

BALL LOADED ANTI-DECOUPLING DEVICE FOR ELECTRICAL CONNECTORS

BACKGROUND DISCUSSION

A typical electrical connector arrangement consists of mating generally cylindrical components such as a plug shell and receptacle shell carrying mating electrical contact elements which are moved into engagement by axial mating movement of the components. The plug shell and receptacle shell are moved axially together to be coupled and maintained in the mated relationship by use of a coupling nut member received over the connector components. The nut member threadedly engages the outside diameter of one of the components and axially engages the other in order to draw the plug and receptacle shells into mating relationship and to securely retain the same in engagement.

This arrangement is simple and reliable, but in severe vibration environments, the nut member may gradually back off allowing unintended disconnection of the components.

Various anti-rotation devices have been devised in the past to counter this tendency including an arrangement disclosed in U.S. Pat. No. 4,109,990. This patent describes a ratcheting arrangement comprised of a spring element bearing a tooth engaged with a series of serrations disposed about the exterior of the connector components. The spring element is mounted extending chordally across the interior of the coupling nut.

The serrations are provided with asymmetrical tooth flanks such as to enable the relative rotation by camming of the tooth to deflect the spring element more easily in the uncoupling direction than the coupling direction.

While such arrangements have been generally successful, constant efforts are being made to improve both the functioning of the arrangement and to reduce the cost thereof.

It is highly desirable that the anti-decoupling feature does not necessitate a substantially increased force to be applied to the nut when intended coupling of the components is being executed.

While the anti-rotation feature resists the vibration induced rotation of the coupling nut, the rotation of the coupling nut during intended decoupling of the connector components should also not be rendered substantially more difficult.

The performance features are desirably achieved without adding appreciably to the complexity of the connector and the manufacturing costs should not be appreciably increased by the inclusion of this feature.

Accordingly, it is an object of the present invention to provide an anti-decoupling feature for generally circular elements which are connected by a mating rotatable coupling nut member as for electrical connector plug and receptacle shells, which is extremely simple and low in cost and effective to prevent vibration induced decoupling thereof, but which does not render the intended rotation of the nut member during coupling and uncoupling of the connected componentry more difficult.

SUMMARY OF THE INVENTION

This and other objects of the present invention, which will become apparent upon a reading of the following specification and claims, are achieved by an anti-rotation arrangement consisting of a deflectable mandrel extending acorss an internal bore of the coupling nut member chordally and in a radial plane and passing adjacent a cylindrical outer surface portion of one of the connector components to define generally wedge-shaped areas on either side of the immediately adjacent surface portion thereof. Slidably disposed on the mandrel is a ball element which is alternately positionable in either wedge-shaped area. In either region, the ball element is located by means of stop fixed shoulders engaging the ball element to maintain a frictional engagement between the ball element and the cylindrical outer surface portion.

Upon attempted rotation in a direction tending to drive the ball element into the wedge-shaped area, a heavy resistance to the rotation of the nut member relative to the connected component is encountered, until such turning force is of sufficient magnitude to cause deflection of the mandrel element and passage of the ball element into the opposite wedge-shaped area. Rotation in the other direction is resisted only by the contact friction of the ball element with the surface portion.

Thus, anti-rctation means is provided resisting rotation in the direction tending to force the ball element into the wedge-shaped area in which it is positioned.

Thus, upon assembly of the connected elements, the ball is driven into the wedge-shaped area and thence further coupling rotation is resisted only by the contact friction into full mating engagement of the connected elements.

Anti-rotation in the uncoupling direction is thus resisted by the tendency for the ball element to wedge, resisting relatively small forces generated by vibration. If a relatively large uncoupling force is applied, this then releases the nut member for uncoupling rotation. A plurality of such mandrel-ball assemblies may be provided about the axis of the nut member.

DETAILED DESCRIPTION

Figure 1:
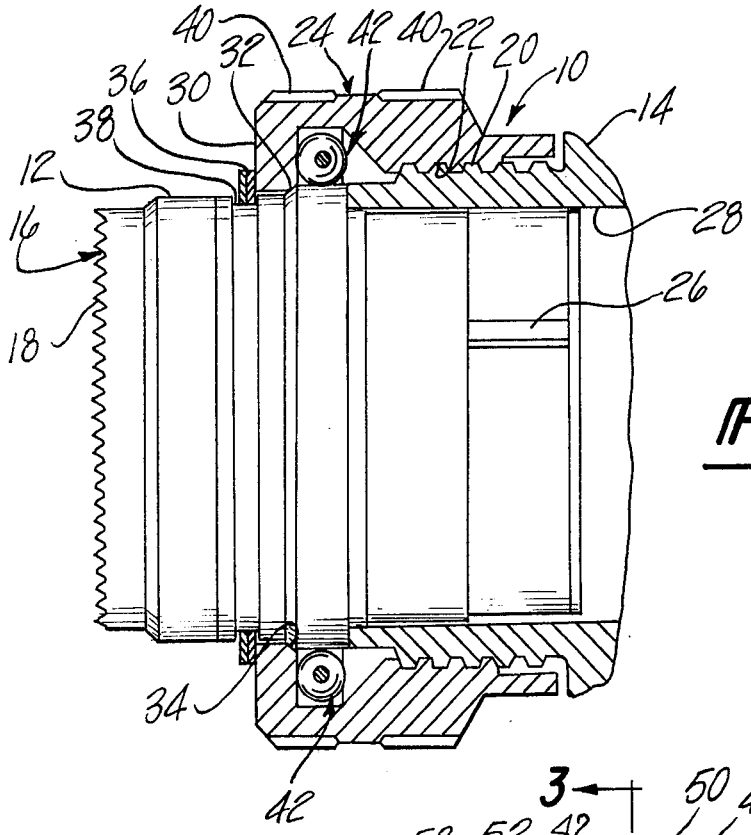
FIG. 1 is a view in partial longitudinal section of the connected plug shell/receptacle shell connector elements together with the coupling nut member incorporating the anti-rotation means according to the present invention.

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Referring to the drawings, the anti-decoupling arrangement is illustrated as applied to an electrical connector assembly 10 in which generally cylindrical electrical connector components are mated by relative axial movement between the mating parts. These parts typically include a plug shell 12 and a receptacle shell 14, plug shell 12 being axially advanced into the interior of the receptacle shell 14. Plug shell 12 and receptacle shell 14 each include electrical contacts (not shown)

which pass into mating engagement upon seating of the respective components in a manner well known to those skilled in the art.

Plug shell 12 typically receives connecting conductors through the opposite face 16, with serrations 18 being provided mating with a strain relief fitting (not shown) secured to the wiring which passes into the plug shell 12 and thence electrically connected to the various electrical contacts.

The receptacle shell 14 is formed with an external thread form 20 which mates with a corresponding thread 22 formed on the interior of a coupling nut member 24. The receptacle shell 14 is maintained in proper orientation with respect to the plug shell 12 by being mated with an asymmetrically located series of keys 26 mating with corresponding keyways formed in the interior bore 28 of the receptacle shell 14.

The coupling nut member 24 is received over both the plug shell 12 and the receptacle shell 14 and as noted is in threaded engagement with one of the electrical connector components, i.e., the receptacle shell 14. The coupling nut member 24 is also provided with a radially inwardly extending portion 30 comprising a flange which engages the plug shell 12 so as to be axially retained thereon. This allows the plug shell 12 and receptacle shell 14 to be drawn together upon rotation of the coupling nut member 24 due to the advance of the receptacle shell 14 by virtue of its threaded engagement with the coupling nut member 24.

Plug shell 12 is formed with a shoulder 32 engaging a corresponding shoulder 34 formed on the interior of the coupling nut member 24 in order to provide an abutment therebetween.

A retaining ring 36 is provided disposed in recess 38 such as to retain the coupling nut member 24 on the plug shell 12.

The outside diameter of the coupling nut member 24 is knurled at 40 in order to facilitate rotation of the coupling nut member 24 during coupling and decoupling of the connector components.

As described in copending application Ser. No. 104,994, filed Dec. 18, 1979, the shoulders 32 and 34 are conically shaped in order to provide an increased frictional interengagement therebetween and a centering action between the various components in order to provide the increased vibration resistance in the mating engagement between the coupling nut member 24 and the plug shell 12 as detailed in the specification of that application.

Anti-decoupling means are provided according to the concept of the present invention to further counter the tendency for the coupling nut member 24 to accidentally back off the receptacle shell 14 due to vibration or other causes such as to result in unintended uncoupling of the plug shell 12 and receptacle shell 14.

The anti-decoupling means includes a plurality of anti-decoupling assemblies 42 disposed about the axis of the connector. Each anti-decoupling assembly 42 includes a deflectable mandrel 44 which is mounted within the interior bore 46 formed in coupling nut member 24.

The deflectable mandrel 44 lies in a radial plane of the connector and extends chordally across the interior bore 46 such as to pass an outer surface portion 48 of the other of the connector elements and the threaded component plug shell 12. The outer surface portion 48 is comprised of a cylindrical surface extending about the axis thereof.

This position of the deflectable mandrel 44 is such as to create a generally wedge-shaped area on either side of an immediately adjacent area 50, in which area the deflectable mandrel 44 passes close to the exterior of the outer surface portion 48 with a slight clearance space therebetween.

Alternately disposed in the respective wedge-shaped areas is a cam element comprised of a ball 52 which is slidably mounted on the deflectable mandrel 44 and located in either of two positions on the deflectable mandrel 44. This is by means of an abutment against either of a pair of bushings 54 which are mounted in transverse openings 56 formed through the sidewall of the coupling nut member 24.

Figure 2:
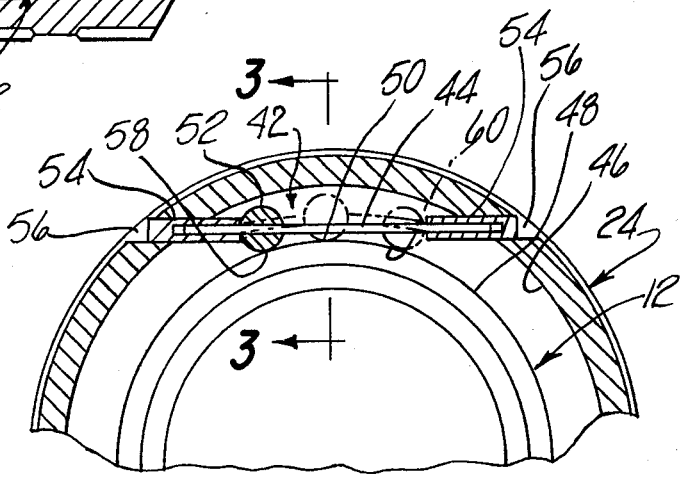
FIG. 2 is a fragmentary transversely sectional view of the assembly shown in FIG. 1 depicting the movement of the anti-decoupling means ball element in phantom.

The end faces of the bushings 54 define abutments or fixed stops which limit the outward travel of the ball 52 such that in its extrememost positions, it is in frictional contact at 58 on one side of the immediately adjacent area 50, or as shown in phantom in FIG. 2 at 60 on the other side of immediately adjacent area 50.

Thus, ball 52 is always in frictional contact with the outer surface portion 48 in every position on deflectable mandrel 44.

In a first direction of rotation, i.e., clockwise as viewed looking in FIG. 2, the frictional contact 58 between ball 52 and outer surface portion 48 tends to drive the ball into wedge-shaped areas which are resisted by the extent of the stiffness of deflectable mandrel 44 against bending.

Thus, a relatively great resisting force is generated acting between the coupling nut member 24 and the plug shell 12 in response to attempted rotation in this direction.

This rotative direction is that tending to result in uncoupling rotation of the coupling nut member 24 such that the anti-decoupling feature is provided.

However, in the opposite direction of rotation, the resistance to relative rotation is constituted only by that force generated by the friction existing between the ball 52 at the contact point and is of a much less magnitude such as to not appreciably cause resistance to coupling rotation of the coupling nut member 24 while the connector components are being assembled.

Figure 3:
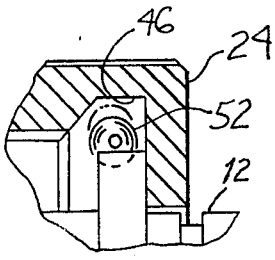
FIG. 3 is a fragmentary view of the anti-decoupling components shown in FIGS. 1 and 2.

However, upon exertion of a sufficient rotative force to the relative force between the coupling nut member 24 and the plug shell 12, the mandrel 44 will deflect, as indicated in phantom in FIGS. 2 and 3, allowing the ball to slide across the deflectable mandrel 44 through and past the immediately adjacent area 50 as indicated in phantom in FIG. 3 and thence into the opposite wedge-shaped area in contact with the contact point 58 and in abutment against the oppositely located bushing 54.

At this point, the coupling nut member 24 can be readily rotated in the opposite direction in order to enable disassembly of the connector components.

Conversely, during assembly, the coupling nut member 24 is rotated to apply a sufficiently high force such as to cause the ball 52 to pass through the clearance space and thence into the initial position shown in FIG. 2 such that the coupling nut member 24 can be readily rotated in order to assemble the connector components.

It can be seen that the above-recited object of the present invention is achieved by the anti-decoupling arrangement described in that it is a very simple structure which will operate in a highly reliable manner and furthermore does not render the disassembly and assembly of the connector components difficult, while at the same time acting to greatly reduce any tendency for vibration induced disassembly by rotation of the coupling nut member 24 out of threaded engagement with the receptacle shell 14.

While this arrangement is disclosed within the context of electrical connectors, it can of course be appreciated that any decoupling feature may be added to similar coupling connections made between generally cylindrical mating elements in other contexts, i.e., on pipe and rod joints of similar configuration.

The embodiments of the invention in which an exclusive property or privilege is claimed are defined as follows:

1. An electrical connector comprising:

first and second generally cylindrical electrical connector bodies, each carrying electrical contacts moved into mating relationship by axial mating movement between said first and second connector bodies;

a coupling nut member adapted to be received over said first and second connector bodies with said electrical connector bodies in mating engagement;

said coupling nut member formed with an internal thread mating with an external thread formed on one of said first or second electrical connector bodies;

said coupling nut member further formed with a radially inwardly extending flange portion in surrounding relationship with the other of said first or second electrical connector bodies;

an abutment formed on said other of said first or second connector bodies axially engaging said coupling nut member flange portion during rotation of said coupling nut member on said one of said first or second electrical connector bodies;

whereby said first and second electrical connector bodies are drawn into mating engagement by said rotation of said coupling nut member;

anti-decoupling means acting between said coupling nut member and said other of said electrical connector bodies, said anti-decoupling means comprising:

a deflectable mandrel and means mounting said mandrel within said coupling nut member extending in a generally radial plane and transversely to the axis of said electrical connector, said mandrel being affixed at either end to said coupling nut member and disposed to be passed adjacent a portion of a cylindrical outer surface of said other of said first or second electrical connector bodies;

a cam element slidably mounted on said mandrel, of greater radial dimension than a clearance space between said mandrel and said adjacent portion of said other of said electrical connector bodies;

means limiting said cam element on said mandrel to axial positions in frictional engagement with said outer surface portion of said other of said first or second electrical connector bodies in every position on said mandrel on either side of said immediately adjacent portion;

whereby relative rotation between said coupling nut member and said other of said first or second electrical connector bodies in a direction tending to cause sliding movement of said cam element towards said immediately adjacent portion of said first or second electrical connector bodies is resisted by friction and the stiffness of said mandrel and relative rotation in the opposite direction is resisted only by the contact friction of said cam element on said surface portion of said other of said first or second electrical connector bodies.

2. The electrical connector according to claim 1 wherein said cam element comprises a ball element having a tangential contact with said cylindrical outer surface of said other of said first or second electrical connector bodies.

3. The electrical connector according to claim 1 wherein said means limiting said cam element position comprises a fixed stop on either side of said mandrel limiting said sliding movement of said cam element on said mandrel to extrememost positions wherein said cam element remains in frictional engagement with said outer surface of said other of said first or second electrical connector bodies.

4. The electrical connector according to claim 3 wherein said means mounting said mandrel comprises transverse bores extending through opposite portions of the sidewall of said nut member, a pair of bushings each mounted in a respective one of said bores, each having a generally larger diameter than said mandrel and receiving a respective one of said fixed ends of said mandrel, each bushing having a terminal end portion adjacent said cam element, whereby said bushing end portions constitute said fixed stops.

5. A coupling arrangement for securing first and second generally cylindrical bodies moved into joined relationship by axial mating movement between said first and second bodies;

a coupling nut member adapted to be received over said first and second bodies;

said coupling nut member formed with an internal thread mating with an external thread formed on one of said first or second bodies;

said coupling nut member further formed with a radially inwardly extending flange portion in surrounding relationship with the other of said first or second bodies;

an abutment formed on said other of said first or second bodies engaging said coupling nut member flange portion during rotation of said coupling nut member with said one of said first or second bodies external thread in engagement with said coupling nut member internal thread;

whereby said first and second bodies are drawn into joined engagement by said rotation of said coupling nut member;

anti-decoupling means acting between said coupling nut member and said other of said first or second bodies, said anti-decoupling means comprising:

a deflectable mandrel and means mounting said mandrel within said coupling nut member extending in a generally radial plane and transversely to the axis of said bodies, said mandrel being affixed at either end to said coupling nut member and disposed to be passed immediately adjacent a portion of a cylindrical outer surface of said other of said first or second bodies;

a cam element slidably mounted on said mandrel of greater radial dimension than a clearance space between said mandrel and said adjacent portion of said other of said bodies;

means limiting said cam element on said mandrel to axial positions in frictional engagement with said outer surface of said other of said first or second bodies in every position on said mandrel on either side of said immediately adjacent portion;

whereby relative rotation between said coupling nut member and said other of said first or second bodies in a direction tending to cause sliding movement of said cam element towards said immediately adjacent portion of said first or second bodies is resisted by friction and the stiffness against bending of said mandrel and relative rotation in the opposite direction is resisted only by the contact friction of said cam element on said surface portion of said other of said first or second electrical connector bodies.

6. The coupling arrangement according to claim 5 wherein said cam element comprises a ball element having a tangential contact with said cylindrical outer surface of said other of said first or second bodies.

7. The coupling arrangement according to claim 5 wherein said means limiting said cam element position comprises a fixed stop on either side of said mandrel limiting said sliding movement of said element on said mandrel to extrememost positions wherein said cam element remains in frictional engagement with said outer surface of said other of said first or second bodies.

8. The coupling arrangement according to claim 7 wherein said means mounting said mandrel comprises transverse bores extending into opposite portions of the sidewalls of said nut member, a pair of bushings each mounted in a respective one of said bores, each having a larger diameter than said mandrel and receiving a respective one of said fixed ends of said mandrel, each bushing having a terminal end portion adjacent said cam element, whereby said bushing end portions constitute said fixed stops.

9. In an electrical connector comprising a plug shell and receptacle shell, each carrying electrical contacts and movable into mating engagement by axial movement therebetween and further including a coupling nut member received over said plug shell and receptacle shell and threadedly engaging one of said plug shell or receptacle shell, said coupling nut member axially engaging the other of said plug shell or receptacle shell such as to draw said plug shell and receptacle shell into mating engagement upon rotation of said coupling nut member, the improvement comprising:

anti-decoupling means consisting of an elongate element mounted within said coupling nut member having either end secured thereto with an intermediate unsupported length extending chordally across said coupling nut located to pass adjacent an outer surface portion of said other of said plug shell or receptacle shell, said outer surface portion consisting of a cylindrical surface formed about the periphery of said other of said plug shell or receptacle shell;

a cam element slidably mounted on said elongate element on said intermediate length thereof, said cam element configured to frictionally engage said outer surface of said other of said plug shell or receptacle shell at positions on said elongate element adjacent said adjacent portion of said outer surface;

means limiting said position of said cam element on said elongate element to be in frictional control with said outer surface and within opposite wedge-shaped regions defined between said elongate element and outer surface portion on either side of said adjacent portion of said outer surface;

whereby rotation of said coupling nut member carrying said elongate element and cam element mounted thereon is resisted by said cam element tending to jam into area in a direction of rotation tending to force said cam element thereinto, until deflection of said elongate element enables said cam element to pass therealong into said opposite wedge-shaped area and whereby said resistance to rotation in said opposite direction tending to move said cam element out of said wedge-shaped area resists rotation only by the contact friction between said cam element and said outer surface.

10. The electrical connector according to claim 9 wherein said cam element comprises a ball lement.

* * * * *